US006891481B2

(12) United States Patent
Dubinsky et al.

(10) Patent No.: US 6,891,481 B2
(45) **Date of Patent: *May 10, 2005**

(54) RESONANT ACOUSTIC TRANSMITTER APPARATUS AND METHOD FOR SIGNAL TRANSMISSION

(75) Inventors: Vladimir Dubinsky, Houston, TX (US); Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 481 days.

This patent is subject to a terminal disclaimer.

(21) Appl. No.: 09/820,065

(22) Filed: Mar. 28, 2001

(65) Prior Publication Data

US 2002/0039328 A1 Apr. 4, 2002

Related U.S. Application Data

(63) Continuation-in-part of application No. 09/676,906, filed on Oct. 2, 2000.

(51) Int. Cl.[7] ..... G01V 1/16
(52) U.S. Cl. ..... 340/854.4; 367/82
(58) Field of Search ..... 340/854.5, 856.4, 340/854.4; 367/82, 189, 190, 41; 181/102, 106, 119, 108, 121; 166/249, 177.1

(56) References Cited

U.S. PATENT DOCUMENTS

| | | | | |
|---|---|---|---|---|
| 3,813,656 A | | 5/1974 | Fowler | 340/18 LD |
| 3,934,673 A | * | 1/1976 | Silverman | 181/119 |
| 4,314,365 A | | 2/1982 | Petersen et al. | 367/82 |
| 4,519,053 A | * | 5/1985 | Bedenbender | 367/190 |
| 4,715,470 A | * | 12/1987 | Paulsson | 181/106 |
| 4,992,997 A | | 2/1991 | Bseisu | 367/82 |
| 5,319,610 A | | 6/1994 | Airhart | 367/82 |
| 5,568,448 A | | 10/1996 | Tanigushi et al. | 367/82 |
| 5,675,325 A | * | 10/1997 | Taniguchi et al. | 340/854.4 |

FOREIGN PATENT DOCUMENTS

GB 2236782 A 4/1991

* cited by examiner

*Primary Examiner*—Michael Horabik
*Assistant Examiner*—Hung Dang
(74) *Attorney, Agent, or Firm*—Madan, Mossman & Sriram, P.C.

(57) ABSTRACT

A well system having a sensor; a controller for converting the sensor output, a signal conducting mass, an actuator for inducing an acoustic wave the signal conducting mass, a reaction mass, an acoustic wave receiver up-hole, and a processor for processing a signal from the acoustic wave receiver and for delivering the processed signal to an output device.

33 Claims, 10 Drawing Sheets

RESONANT ACOUSTIC TRANSMITTER APPARATUS AND METHOD FOR SIGNAL TRANSMISSION

RELATED APPLICATIONS

This application is a continuation-in-part of U.S. patent application Ser. No. 09/676,906 filed on Oct. 2, 2000 now pending and which is hereby incorporated in its entirety herein by reference.

BACKGROUND OF THE INVENTION

1. Field of the Invention

This invention relates generally to oil field tools, and more particularly to acoustic data telemetry devices for transmitting data from a downhole location to the surface.

2. Description of the Related Art

To obtain hydrocarbons such as oil and gas, boreholes are drilled by rotating a drill bit attached at a drill string end. A large proportion of the current drilling activity involves directional drilling, i.e., drilling deviated and horizontal boreholes, to increase the hydrocarbon production and/or to withdraw additional hydrocarbons from the earth's formations. Modern directional drilling systems generally employ a drill string having a bottomhole assembly (BHA) and a drill bit at end thereof that is rotated by a drill motor (mud motor) and/or the drill string. A number of downhole devices in the BHA measure certain downhole operating parameters associated with the drill string and the wellbore. Such devices typically include sensors for measuring downhole temperature, pressure, tool azimuth, tool inclination, drill bit rotation, weight on bit, drilling fluid flow rate, etc. Additional downhole instruments, known as measurement-while-drilling ("MWD") and logging-while-drilling ("LWD") devices in the BHA provide measurements to determine the formation properties and formation fluid conditions during the drilling operations. The MWD or LWD devices usually include resistivity, acoustic and nuclear devices for providing information about the formation surrounding the borehole.

The trend in the oil and gas industry is to use a greater number of sensors and more complex devices, which generate large amounts of measurements and thus the corresponding data. Due to the copious amounts of downhole measurements, the data is typically processed downhole to a great extent. Some of the processed data must be telemetered to the surface for the operator and/or a surface control unit or processor device to control the drilling operations, which may include altering drilling direction and/or drilling parameters such as weight on bit, drilling fluid pump rate, and drill bit rotational speed. Mud-pulse telemetry is most commonly used for transmitting downhole data to the surface during drilling of the borehole. However, such systems are capable of transmitting only a few (1–4) bits of information per second. Due to such a low transmission rate, the trend in the industry has been to attempt to process greater amounts of data downhole and transmit only selected computed results or "answers" uphole for controlling the drilling operations. Still, the data required to be transmitted far exceeds the current mud-pulse and other telemetry systems.

Although the quality and type of the information transmitted uphole has greatly improved since the use of microprocessors downhole, the current systems do not provide telemetry systems, which are accurate and dependable at low frequencies of around 100 Hz.

Acoustic telemetry systems have been proposed for higher data transmission rates. Piezoelectric materials such as ceramics began the trend. Ceramics, however require excessive power and are not very reliable in a harsh downhole environment. Magnetostrictive material is a more suitable material for downhole application. Magnetostrictive material is a material that changes shape (physical form) in the presence of a magnetic field and returns to its original shape when the magnetic field is removed. This property is known as magnetostriction.

Certain downhole telemetry devices utilizing a magnetostrictive material are described in U.S. Pat. No. 5,568,448 to Tanigushi et al. and U.S. Pat. No. 5,675,325 to Taniguchi et al. These patents disclose the use of a magnetostrictive actuator mounted at an intermediate position in a drill pipe, wherein the drill pipe acts as a resonance tube body. An excitation current applied at a predetermined frequency to coils surrounding the magnetostrictive material of the actuator causes the drill pipe to deform. The deformation creates an acoustic or ultrasonic wave that propagates through the drill pipe. The propagating wave signals are received by a receiver disposed uphole of the actuator and processed at the surface.

The above noted patents disclose that transmission efficiency of the generated acoustic waves is best at high frequencies (generally above 400 hz). The wave transmission, however drops to below acceptable levels at low frequencies (generally below 400 hz). An acoustic telemetry system according to the above noted patents requires precise placement of the actuator and unique "tuning" of the drill pipe section with the magnetostrictive device in order to achieve the most efficient transmission, even at high frequencies.

The precise placement requirements and low efficiency is due to the fact that such systems deform the drill pipe in order to induce the acoustic wave. In such systems, the magnetostrictive material works against the stiffness of the drill pipe in order to deform the pipe. Another drawback is that the deformation tends to be impeded by forces perpendicular ("normal" or "orthogonal") to the longitudinal drill pipe axis. In downhole applications, extreme forces perpendicular to the longitudinal drill pipe axis are created by the pressure of the drilling fluid ("mud") flowing through the inside of the drill pipe and by formation fluid pressure exerted on the outside of the drill pipe. Although the pressure differential across the drill pipe surface (wall) approaches zero with proper fluid pressure control, compressive force on the drill pipe wall remains. Deformation of the drill pipe in a direction perpendicular to the longitudinal axis is impeded, because the compressive force caused by the fluid pressure increases the stiffness of the drill pipe.

The present invention addresses the drawbacks identified above by using an acoustic actuator source to resonate a reaction mass separated from the portion of the tube body through which acoustic wave transmission occurs. With a large reaction mass, efficient transmission can be achieved even at relatively low frequencies (below 400 Hz).

SUMMARY OF THE INVENTION

To address some of the deficiencies noted above, the present invention provides an apparatus and a method for transmitting a signal from a downhole location through the drill or production pipe at low frequencies with high efficiencies. The present invention also provides a MWD, completion well and production well telemetry system utilizing an actuator and reaction mass to induce an acoustic wave indicative of a parameter of interest into a drill pipe or production pipe.

The present invention includes a well system having a sensor for detecting at least one parameter of interest down hole; a controller for converting an output of the sensor to a first signal indicative of the at least one parameter of interest; at least one signal conducting mass; at least one actuator in communication with the at least one signal conducting mass for receiving the first signal from the controller and for inducing an acoustic wave representative of the first signal into the signal conducting mass; a reaction mass in communication with the at least one actuator wherein the signal conducting mass is coupled to the reaction mass by the at least one actuator; an acoustic wave receiver disposed in the at least one signal conducting mass for receiving the acoustic wave and for converting the acoustic wave to a second signal indicative of the at least one parameter of interest; and a processor for processing the second signal from the acoustic wave receiver and for delivering the processed second signal to an output device.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1A:
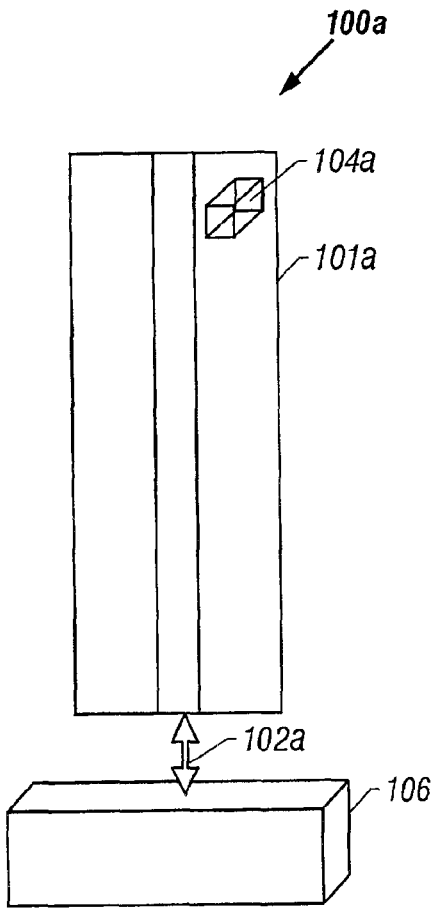
FIGS. 1A and 1B show schematic drawings of the conceptual difference between the present invention and prior art identified herein.
Figure 1B:
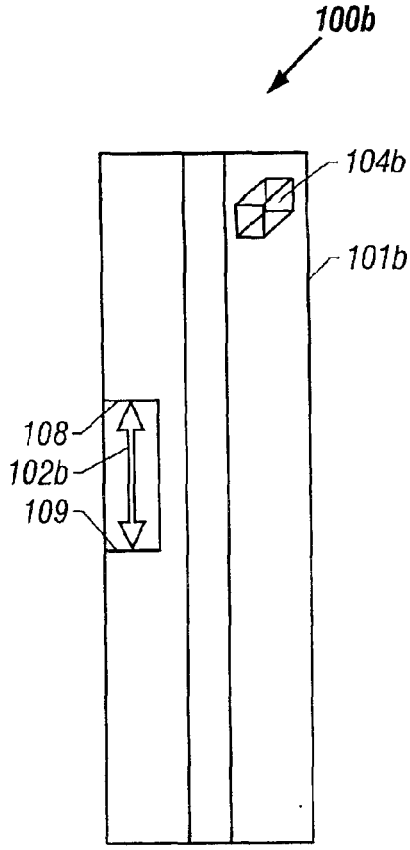

FIG. 1A is a schematic diagram of a system 100*a* illustrating the concept of the present invention while FIG. 1B shows the concept of a prior art telemetry systems 100*b* described above. In each case, an acoustic wave travels through a drill pipe or other tube-like mass 101 a and 101*b* respectively, which acoustic wave is received by a corresponding receiver 104*a* and 104*b*. In the present invention, the acoustic wave is generated by an actuator, which is described below in more detail with respect to specific embodiments. In the configuration of FIG. 1B, the acoustic wave is generated by applying a force 102*b* against surfaces 108 and 109 within a cavity formed in the wall of the drill pipe 101*b*. The force 102*b* works against the stiffness of the drill pipe 101*b*. The stiffness of the pipe acts as a damping force, which requires a large amount of power to induce a sufficient portion of the force 102*b* axially into the drill pipe 101*b* to generate the acoustic wave. Such a system is relatively inefficient. In addition, it has been found that a system such as system 100*b* is even less effective at frequencies below 400 Hz compared to frequencies above 1000 Hz. Furthermore, systems such as 100*b* require exact placement of and unique "tuning" of the drill pipe section containing the magnetostrictive actuator. The U.S. Pat. Nos. 5,568,448 and 5,675,325 noted above indicate that the optimum placement of the actuator in a drillpipe section is substantially midway between an upper and a lower end of the drill pipe section.

In the system 100*a* of the present invention a force 102*a* reacts with a reaction mass 106 and the drill pipe 101*a* in a manner that eliminates or substantially reduces the damping effects of the drill pipe stiffness. The mass of the reaction mass 106 is selected to be much greater than the mass of the drill pipe 101*a* so that the force 102*a* can "lift" or move the drill pipe 101*a* away from the reaction mass 106 with relatively negligible displacement of the reaction mass 106. The overall resultant force 102*a* is transferred to the drill pipe 101*a*. In this manner, a much greater portion of the force generated by the actuator is transmitted to the drill pipe 101*a* in the system configuration of FIG. 1A compared to the configuration shown in FIG. 1B. In an alternative embodiment, the mass of the reaction mass may be reduced when the actuator is used to oscillate the reaction mass at a high amplitude with a relatively low frequency. The system of FIG. 1A requires substantially less power to induce an acoustic wave into the drill pipe compared to the system of FIG. 1B. The acoustic wave induced in the drill pipe 101*a* is detected by an acoustic receiver 104*a* located near the surface.

Figure 2:
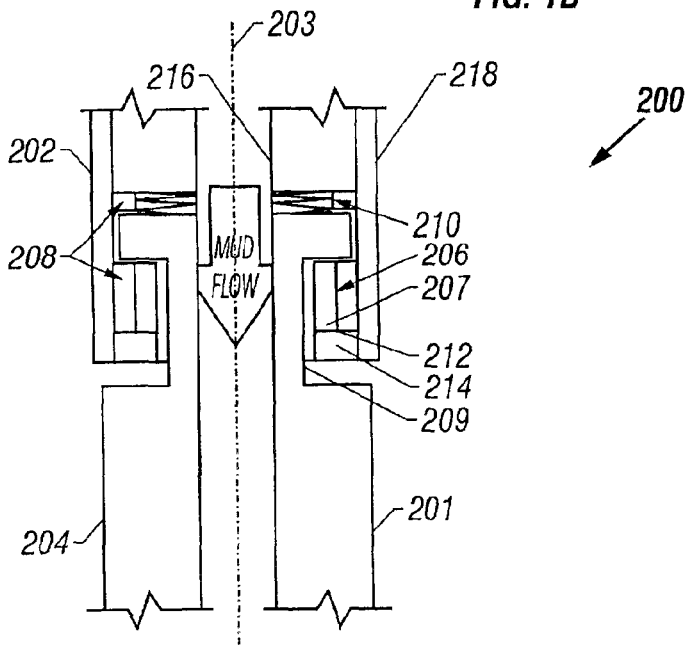
FIG. 2 is a cross section schematic showing a free reaction mass embodiment of the present invention.

FIG. 2 is a cross section schematic diagram of an acoustic telemetry system 200 according to one embodiment of the present invention. This telemetry system 200 includes a reaction mass 204, which may be a lower section 201 of a drill string 200 and a substantially free section 202, which may be an upper section 202 of the drill string 200. The free section 202 is preferably a drill pipe. An acoustic actuator 206 including a force application member 207 made from a suitable magnetostrictive material, such as Terfenol-D® is disposed around a portion 209 of the reaction mass 204. When current is applied to coils (not shown) surrounding the force application member 207, a magnetic field is created around the member 207. This magnetic field causes the magnetostrictive material 207 to expand along the longitudinal axis 203 of the drill pipe 202. Removing the current from the coils causes the magnetostrictive material 207 to contract to its original or near-original position. Repeated application and removal of the current to the coils at a selected frequency causes the actuator 206 to apply force on the section 202 at the selected frequency. This action induces an acoustic wave in the drill pipe 202. The acoustic wave is detected by a dector or receiver (described later) that is placed spaced apart from the actuator 206.

The drill string includes one or more downhole sensors (not shown) which provide to a controller signals representative of one or more for parameters of interest, which may include a borehole parameter, a parameter relating to the drill string and the formation surrounding the wellbore. The controller converts the sensor signal to a current pulse string, and delivers the current pulse string to the coils of actuator 206. With each current pulse, the actuator expands, thereby applying a force to the transmission mass 28. of the drill string 200 and to the reaction mass 204.

The upper section 202 is in a movable relationship with the lower section 201 such that the lower section 201 applies a compressive force to the magnetostrictive material 207. The actuator 206 is restrained at a lower end 212 by a restraining lip or portion 214 of the upper section 202. A compression spring 210 ensures that a selected amount of compression remains on the force application member 207 at all times. Stops or travel restrictors 208 provide control of the relative movement between the lower section 201 and the actuator 206.

In the embodiment of FIG. 2, the drill string 200 is assembled such that the effective mass of the lower section 201 is much greater than the mass of the upper section 202. When current is applied to the coils of the actuator 206, magnetostriction in the actuator creates an acoustic wave in the upper section 202. Since the effective mass of the lower section 201 is much greater than that of the upper section 202, most of the acoustic wave travels in the upper section 202. The pressure exerted on the inner wall 216 of the drill string 200 by drilling mud 219 flowing therethrough has little negative effect on the efficiency of the present invention, because the device of FIG. 2 does not rely on flexing the drill string section 204 or 202 in a direction perpendicular to the longitudinal axis 203 of the drill string 200.

Figure 3:
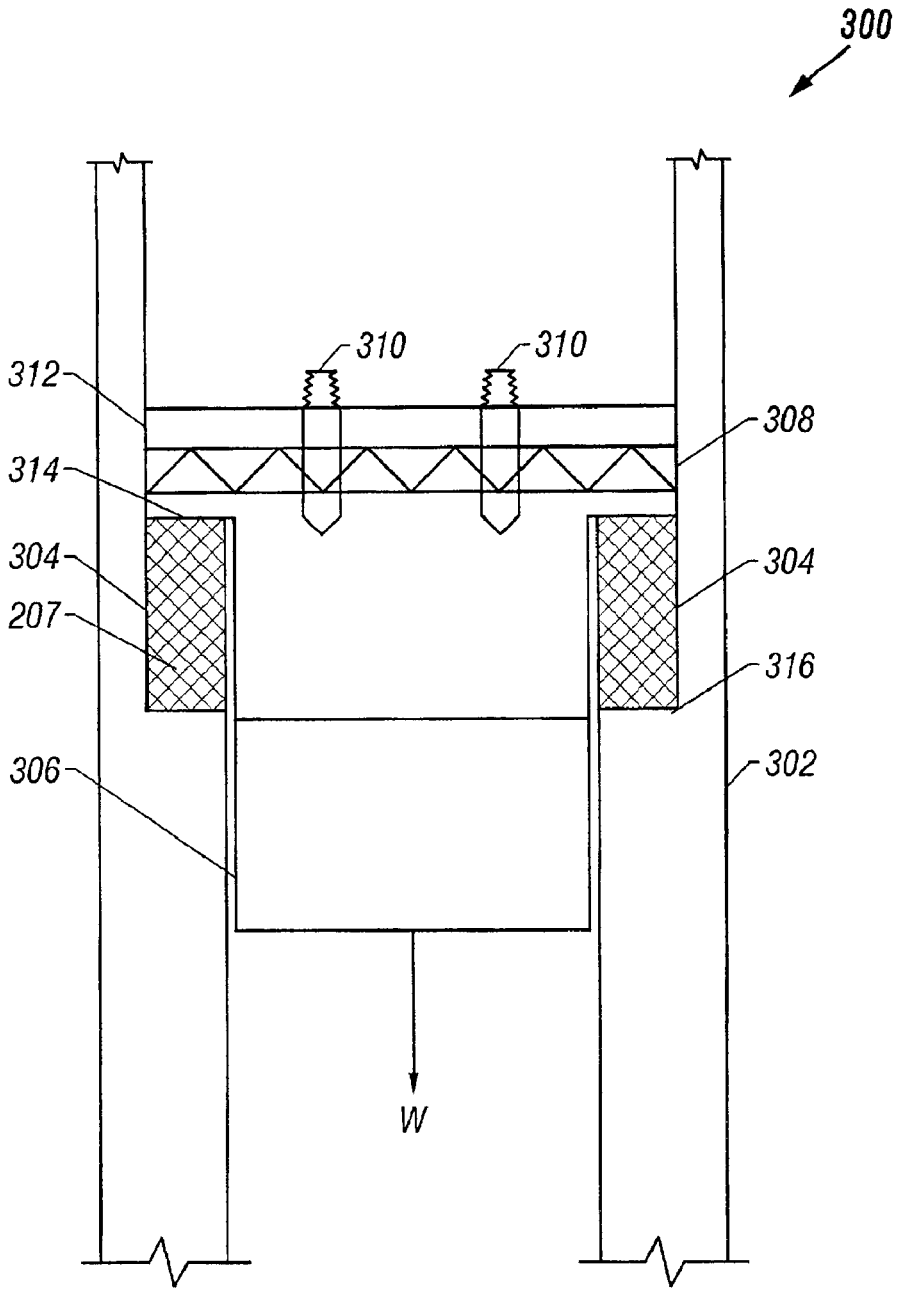
FIG. 3 is a cross section schematic showing a reaction mass embodiment of the present invention.

FIG. 3 is a cross section schematic showing an alternative reaction mass embodiment for the acoustic telemetry system of the present invention. In this embodiment, a reaction mass 306 with its associated weight w is suspended within a drill string section 300 that includes a drill pipe 302. A substantial portion of the weight of the reaction mass 306 is born by a magnetostrictive actuator 304 at an upper end 314 of the actuator. The actuator 304 is restrained from downward axial movement downward by a restraining lip or portion 316 and upward axial movement being restrained by the reaction mass 306. A rotational restraining device such as pins 310 may be used to minimize energy losses from non-axial movement and to ensure that forces generated by the actuator 304 are directed into the drill pipe 302.

The actuator 304 includes a force application member 207 similar to the member shown in FIG. 2. For effective transfer of actuator energy to the drill pipe 302, the force application member 207 is maintained under a certain amount of compression at all times. To provide the compression, a spring 308 may be disposed above the reaction mass 306. A retention device 312 provides an upper restraint for the spring 308. The retention device 312 is attached to the drill pipe 302 in a fixed manner to inhibit or prevent movement of the retention device 312 relative to the drill pipe 302. With this arrangement, the drill pipe 302 is longitudinally displaced by forces generated by the magnetostrictive actuator 304.

The operation of the embodiment shown in FIG. 3 is similar to the operation of the embodiment shown in FIG. 2. The main distinction is that the reaction mass in FIG. 2 is the lower section 204 of the drill string 200, while the reaction mass 306 in FIG. 3 is not an integral part of the drill string section 300.

The embodiment of FIG. 3 uses one or more downhole sensors (not shown) associated with the drill string to provide signals representing one or more parameters to a controller (not shown). The controller converts the sensor signals to a current pulse string and delivers the string of pulses to the coils of actuator 304 at a selected frequency. With each current pulse, the actuator 304 as applies a force to the drill pipe 302 and to the reaction mass 306. The weight of the reaction mass 306 is selected to be sufficiently larger so that a the drill pipe 302 is moved axially away from the reaction mass 306 and returned to the original position at the selected frequency, thereby creating an acoustic wave in the drill pipe 302. The acoustic wave is then received by a receiver (not shown) that is positioned spaced apart from the actuator 304.

Figure 4A:
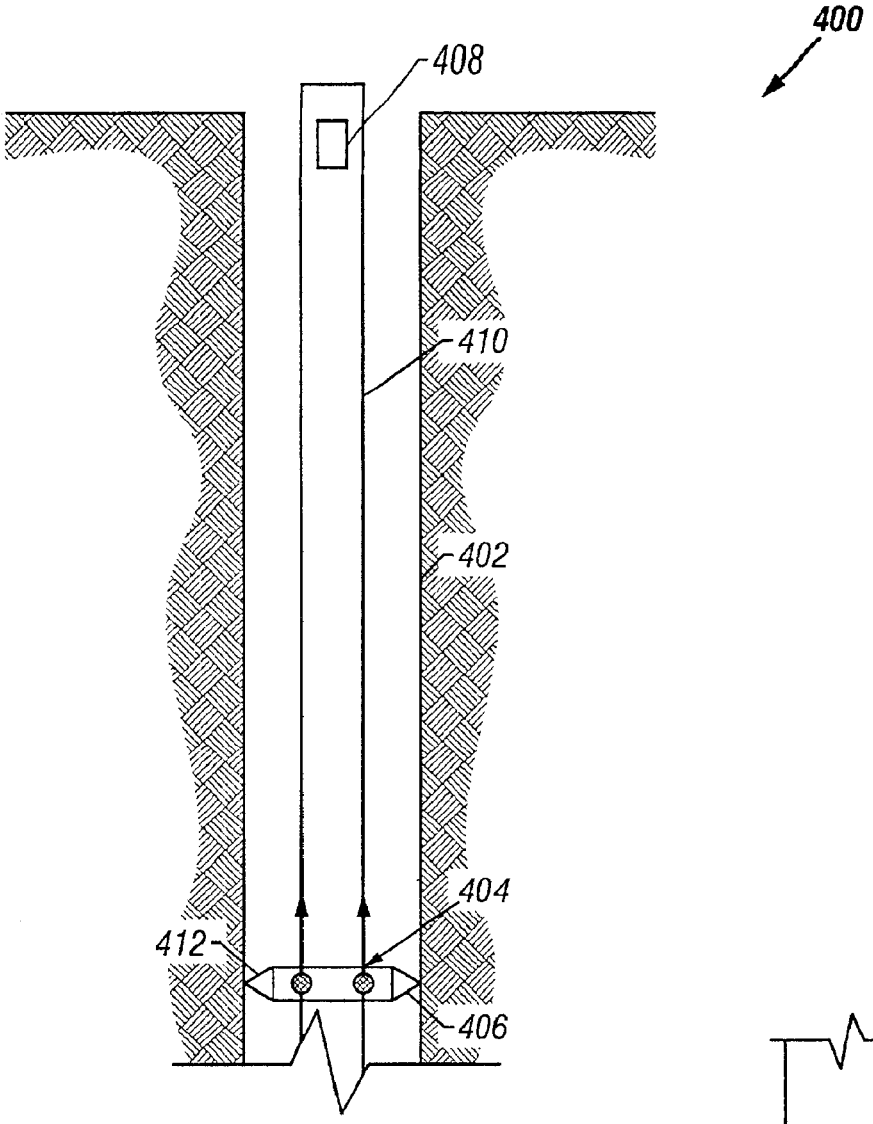
FIG. 4A is a schematic showing an embodiment of the present invention wherein the reaction mass is created by a "dead end" wherein the entire pipe moves axially with respect to force application members.

FIG. 4A is a schematic showing an embodiment of a portion of a telemetry system 400 according to the present invention wherein the reaction mass is created by a "dead end" 406. This embodiment can be especially useful in completion and production well applications. In the embodiment of FIG. 4A, an anchor mechanism or device 406 which may be expandable pads or ribs, is disposed on the pipe 410. The device 406 can be selectively operated to engage the drill pipe or disengage the drill pipe from the borehole 402. Upon user or controller initiated commands, the device 406 extends until it firmly engages with the inner wall 412 of the borehole 402.

The anchor mechanism 406 can be disengaged from the borehole 402 upon command. The anchor mechanism may be a hydraulic, pneumatic, or an electromechanical device that can be operated or controlled from a surface location or which maybe a fully downhole controlled device. Still referring to FIG. 4A, a magnetostrictive actuator 404 such as one described above, is preferably mounted within the anchor mechanism 406. The pipe 410 and the anchor mechanism 406 are coupled in an axially moveable relationship with each other so that the drill pipe 410 can be axially displaced relative to the section 406 along the longitudinal pipe axis 409 when the actuator 404 is activated. The anchor mechanism 406 engages with the borehole 402 to exert sufficient pressure on the borehole wall 412 to ensure that anchor mechanism 406 is not displaced relative to the borehole wall 412 when the actuator 404 is activated. Not shown is a preloading spring as in the other embodiments, however a spring or another preloading device may be used to maintain the magnetostrictive element of the actuator 404 under compression.

The fixed relationship between the anchor mechanism 406 and the borehole 402 creates an acoustic wave "dead end" in the pipe 410 at the anchor mechanism 406. Anchoring of the pipe 410 causes the mass of the earth to act as the reaction mass. Thus, the dead end at the anchors 406 acts as the reaction mass point and causes the acoustic wave generated by the actuator 404 to travel in the drill pipe along the drill pipe section above the dead end.

Figure 4B:
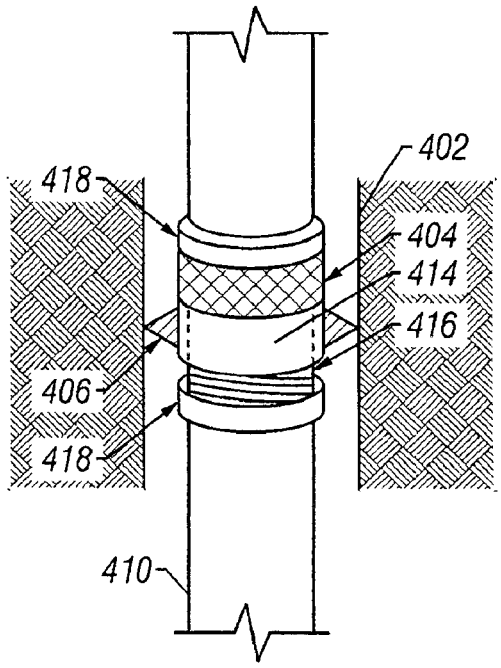
FIG. 4B is a detailed schematic of a magnetostrictive device mounted with force application members on a sleeve coupled to a drill pipe, which allows axial movement of the entire pipe relative to the sleeve.

FIG. 4B is an elevation view of one possible way to configure the embodiment described with respect to FIG. 4A to achieve a forceful interface with the borehole 402 while allowing axial displacement of the pipe 410. The pipe 410 includes keeper rings or offsets 418. Disposed around the pipe 410 and between the offsets 418 are the magnetostrictive material 404, a free-sliding sleeve or ring 414 and a biasing element or spring 416. Ribs 406 are mounted on the sleeve 414, so the ring becomes fixed when the ribs 406 apply force to the borehole wall 412. When the magnetostrictive material 404 is activated, substantially all of the force is transferred to the offsets 418, thus axially displacing the pipe 410. The biasing element 416 ensures a minimum predetermined compression load is maintained on the magnetostrictive material 404.

Figure 4C:
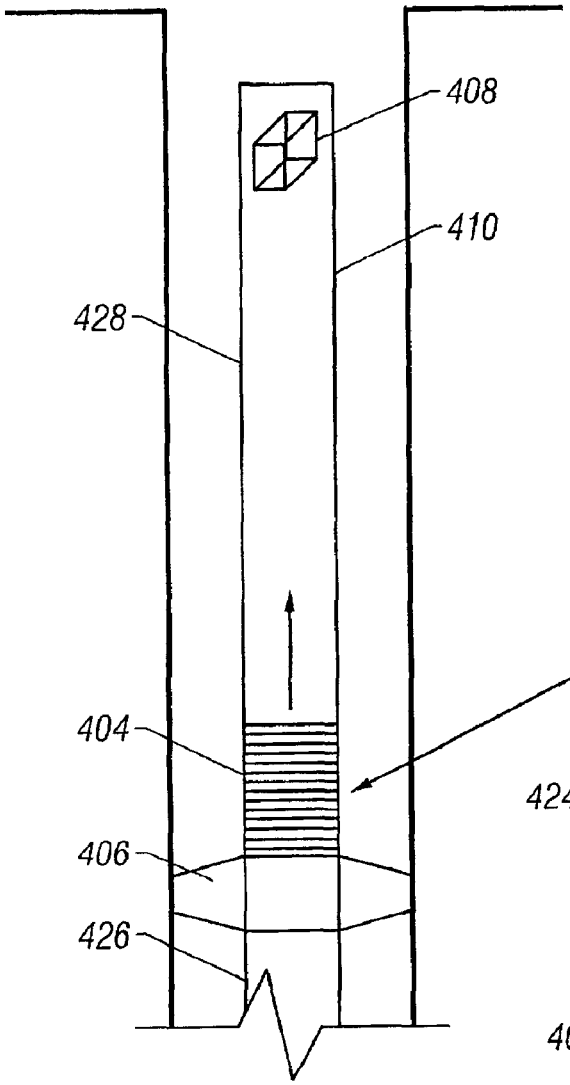
FIG. 4C is a schematic showing an embodiment of the present invention wherein the reaction mass is created by a "dead end" wherein only an upper section of pipe moves axially with respect to force application members.
Figure 4D:
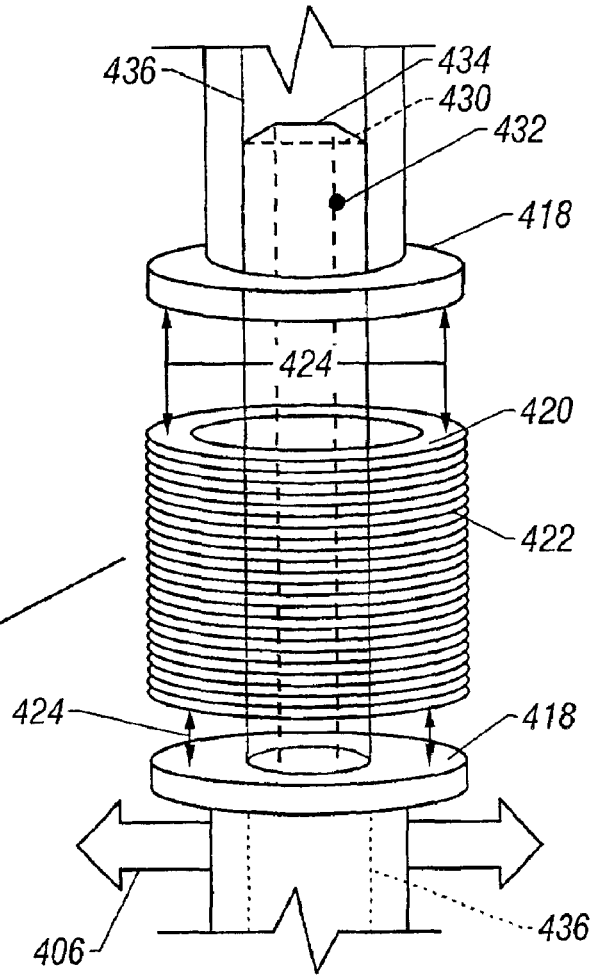
FIG. 4D is a detailed schematic of a magnetostrictive device mounted between a lower section of pipe and an upper section of pipe such that only the upper section of pipe moves axially with respect to force application members mounted on the lower section of pipe.

Another dead end embodiment according to the present invention is shown in FIG. 4C. FIG. 4C shows ribs 406 applying force to the inner wall 412 of the borehole 402. The ribs 406 are mounted on a lower section of pipe 426 below the actuator 404. In this embodiment, the upper section of pipe 428 experiences substantially all of the axial displacement when the actuator 404 is excited. Shown in FIG. 4D is the actuator 404 with a cylindrical magnetostrictive core 420 and coils or windings 422. The coils 422 are wound around the cylindrical core 420.

The actuator 404 is attached to offsets 418 located on the upper section of pipe 428 and to the lower section of pipe 426 by any suitable manner, such as with fasteners 424. A biasing member, (not shown) maintains the actuator 404 in compression to a predetermined amount. The biasing member may be placed above or below the actuator 404.

The drill pipe 410 may include a section of reduced diameter 430 that is sized to be inserted in the inner bore 436 of the other pipe 428 for added stability between the upper section 428 and lower section 426. Of course the reduced diameter pipe 430 could also be carried by the upper pipe section 428 and be inserted into the inner bore 436 of the lower pipe 428. The reduced diameter pipe 430, which should be rigidly fixed (e.g. welded or milled as one piece) to the lower section 426, and have an internal through bore 434 to allow mud to flow for drilling operations. The reduced diameter pipe 430 should have a non-rigid connection such as a steel pin 432 to connect it to the upper sections 428 through a hole or slot in the upper section 428. This non-rigid connection would provide the necessary horizontal stability and rotational stability while maintaining enough freedom of movement in the vertical (axial) direction for transmitting the data pulses generated by the magnetostrictive element 404. As described above, either pipe may carry the reduced diameter pipe 430, and so either pipe may include the rigid or the non-rigid connection.

The configuration just described allows the upper section of pipe 428 to move axially with respect to the lower section of pipe 426. With the actuator 404 coupled above the ribs 406, an acoustic wave is transferred mostly through the upper section of pipe 428 to be received at the surface or intermediate location by a receiver 408. As with all other embodiments described herein, the stiffness of the pipe is decoupled from the actuator 404 movement thereby making transmission more efficient, even at low frequencies.

Figure 5:
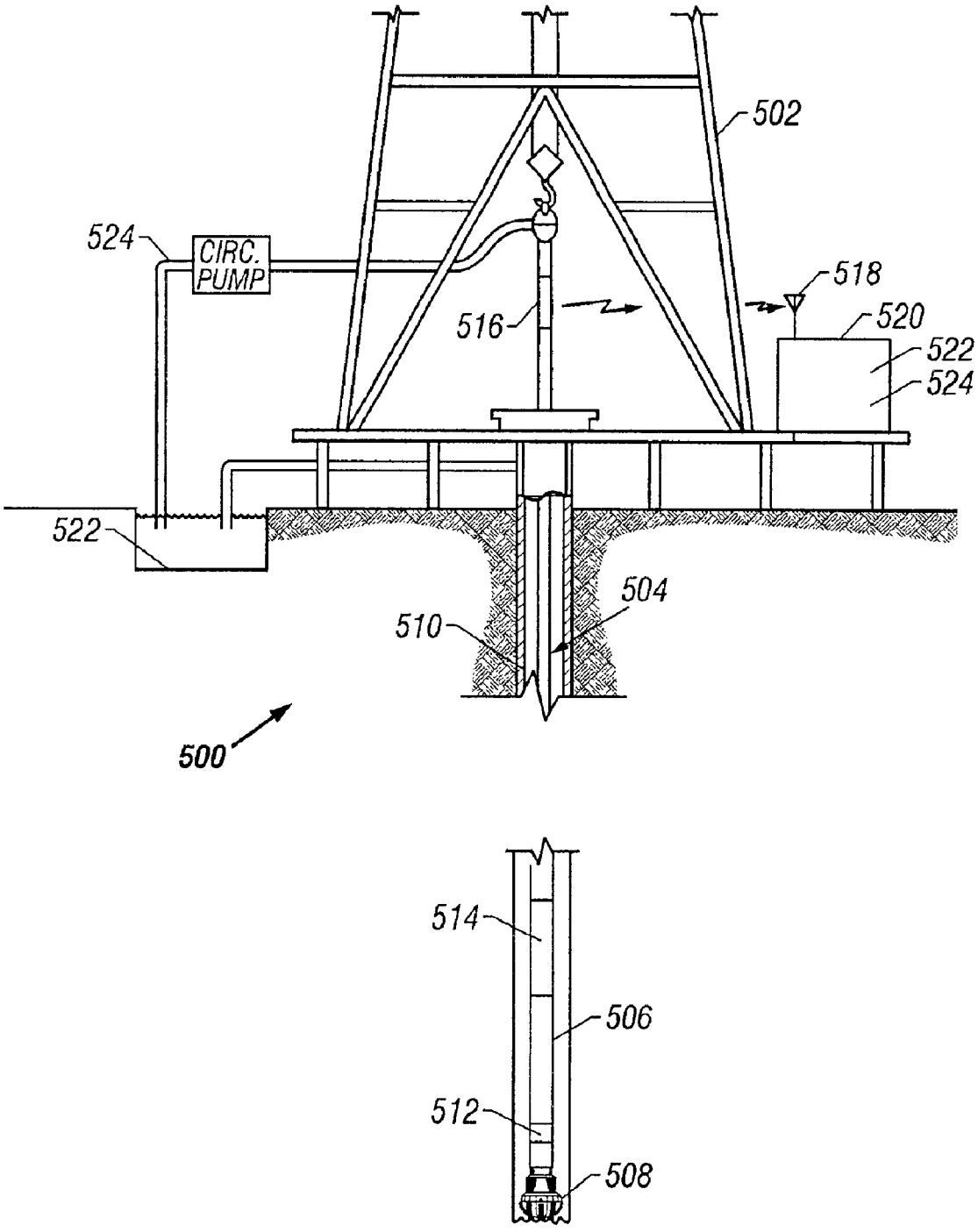
FIG. 5 is an elevation view of a drilling system in a MWD arrangement according to the present invention.

FIG. 5 is an elevation view of a drilling system 500 in a measurement-while-drilling (MWD) arrangement according to the present invention. As would be obvious to one skilled in the art, a completion well system would require reconfiguration; however the basic components would be the same as shown. A conventional derrick 502 supports a drill string 504, which can be a coiled tube or drill pipe. The drill string 504 carries a bottom hole assembly (BHA) 506 and a drill bit 508 at its distal end for drilling a borehole 510 through earth formations.

Drilling operations include pumping drilling fluid or "mud" from a mud pit 522, and using a circulation system 524, circulating the mud through an inner bore of the drill string 504. The mud exits the drill string 504 at the drill bit 508 and returns to the surface through the annular space between the drill string 504 and inner wall of the borehole 510. The drilling fluid is designed to provide the hydrostatic pressure that is greater than the formation pressure to avoid blowouts. The mud drives the drilling motor (when used) and it also provides lubrication to various elements of the drill string. Commonly used drilling fluids are either water-based or oil-based fluids. They also contain a variety of additives which provide desired viscosity, lubricating characteristics, heat, anti-corrosion and other performance characteristics.

A sensor 512 and a magnetostrictive acoustic actuator 514 are positioned on the BHA 506. The sensor 512 may be any sensor suited to obtain a parameter of interest of the formation, the formation fluid, the drilling fluid or any desired combination or of the drilling operations. Characteristics measured to obtain to desired parameter of interest may include pressure, flow rate, resistivity, dielectric, temperature, optical properties tool azimuth, tool inclination, drill bit rotation, weight on bit, etc. The output of the sensor 512 is sent to and received by a downhole control unit (not shown separately), which is typically housed within the BHA 506. Alternatively, the control unit may be disposed in any location along the drill string 504. The controller further comprises a power supply (not shown) that may be a battery or mud-driven generator, a processor for processing the signal received from the sensor 512, a converter for converting the signal to a sinusoidal or pulsed current indicative of the signal received, and a conducting path for transmitting the converted signal to coils of actuator 514. The actuator 514 may be any of the embodiments as described with respect to FIGS. 2–4, or any other configuration meeting the intent of the present invention.

The acoustic actuator 514 induces an acoustic wave representative of the signal in the drill pipe 504. A reaction mass 505 may be the lower portion of the drill string 504, may be a separate mass integrated in the drill string 504, or may be effectively created with a dead end by using a selectively extendible force application member (see FIGS. 2–4). The acoustic wave travels through the drill pipe 504, and is received by an acoustic wave receiver 516 disposed at a desired location on the drill string 504, but which is typically at the surface. A receiver 516 converts the acoustic wave to an output representative of the wave, thus representative of the parameter measured downhole. The converted output is then transmitted to a surface controller 520, either by wireless communication via an antenna 518 or by any conductor suitable for transmitting the output of the receiver 516. The surface controller 520 further comprises a processor 522 for processing the output using a program and an output device 524 such as a display unit for real-time monitoring by operating personnel, a printer, or a data storage device.

Figure 6:
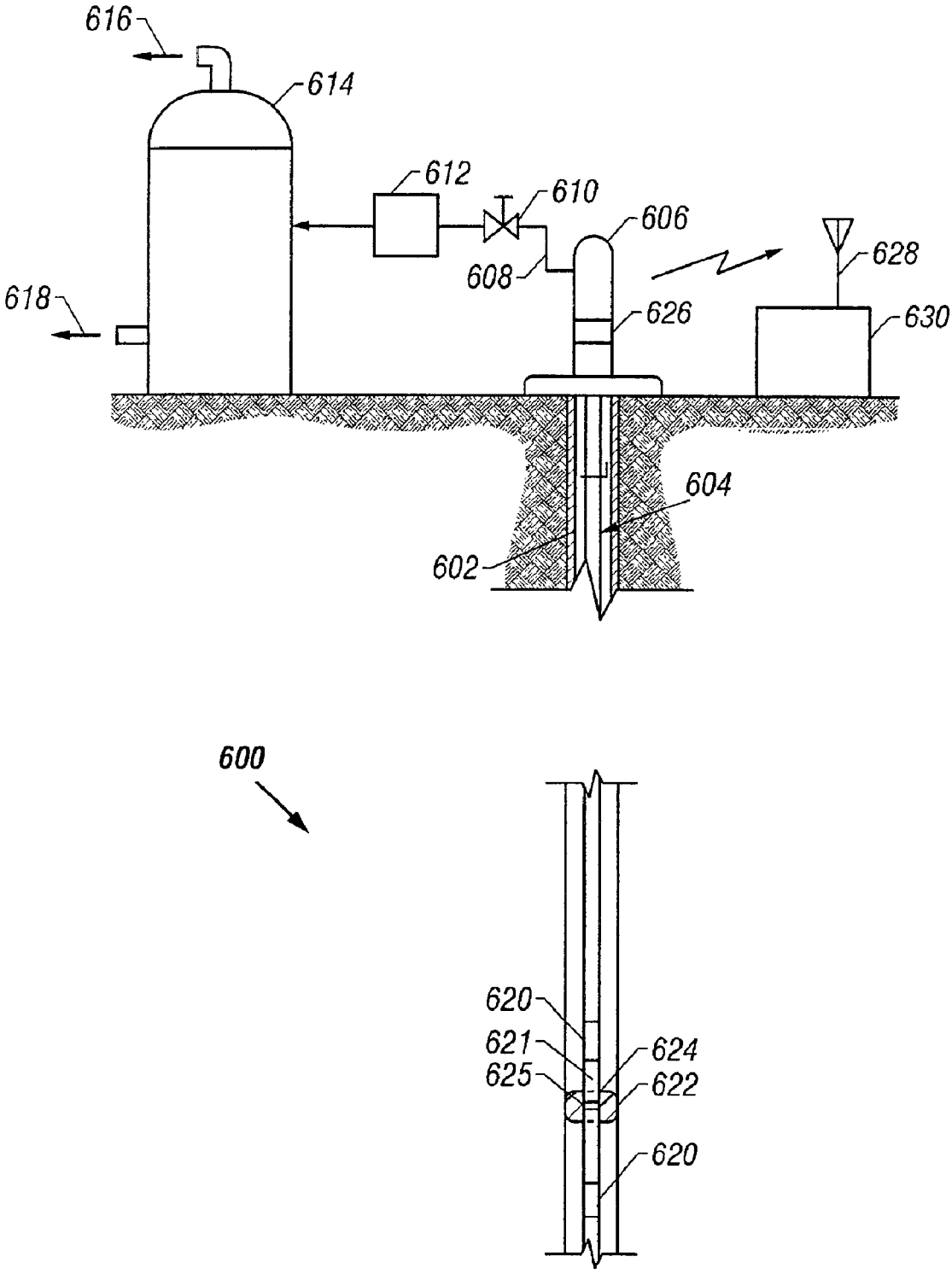
FIG. 6 is an elevation view of a production well system according to the present invention.

An embodiment of a production well telemetry system according to the present invention is shown in FIG. 6. The production well system 600 includes a production pipe 604 disposed in a well 602. At the surface a conventional wellhead 606 directs the fluids produced through a flow line 608. Control valve 610 and regulator 612 coupled to the flow line 608 are used to control fluid flow to a separator 614. The separator 614 separates the produced fluid into its component parts of gas 616 and oil 618. Thus far, the system described is well known in the art.

The embodiment shown for the production well system 600 includes a dead end configuration of an acoustic actuator 624. A suitable dead end configuration is described above and shown in FIG. 4. The acoustic actuator 624 includes at least one force application member 622 and a magnetostrictive material 625. Sensors 620 may be disposed above or below the force application member 622 to obtain desired characteristics and output a signal representing the characteristics. A downhole controller 621 includes a power supply, a processor for processing the output signal of the sensor 620, a converter for converting the signal to a sinusoidal or pulsed current indicative of the signal received, and a conducting path for transmitting the converted signal to the acoustic actuator 624. In a production configuration such as shown in FIG. 6, the controller 621 for the downhole operations may be located on the surface instead of downhole.

Magnetostrictive material 625 in the actuator 624 reacts to the current supplied by the controller by inducing an acoustic wave in the production pipe 604. The reaction mass is effectively created with a dead end by using a selectively extendible force application member 622 extended to engage the well wall. The acoustic wave travels through the production pipe 604, and is received by an acoustic wave receiver 626 disposed at any location on the production pipe 604, but which is typically at the surface in the wellhead 606. The receiver 626 converts the acoustic wave to an output indicative of the wave, thus indicative of the parameter measured downhole. The output is then transmitted to a surface controller 630 by wireless communication via an antenna 628 or by a conductor suitable for the output of the receiver 626. The surface controller 630 further comprises a processor for processing the signal using a program and an output device such as a display unit for real-time monitoring by operating personnel, a printer, or a data storage device.

Embodiments of the present invention described above and shown in FIGS. 2–6 utilize an acoustic actuator (driver) comprising a magnetostrictive material to generate force within an acoustic transmitter system. Other embodiments to be described below in detail utilize alternative driver devices to generate forces necessary to resonate a reaction mass.

Figure 7:
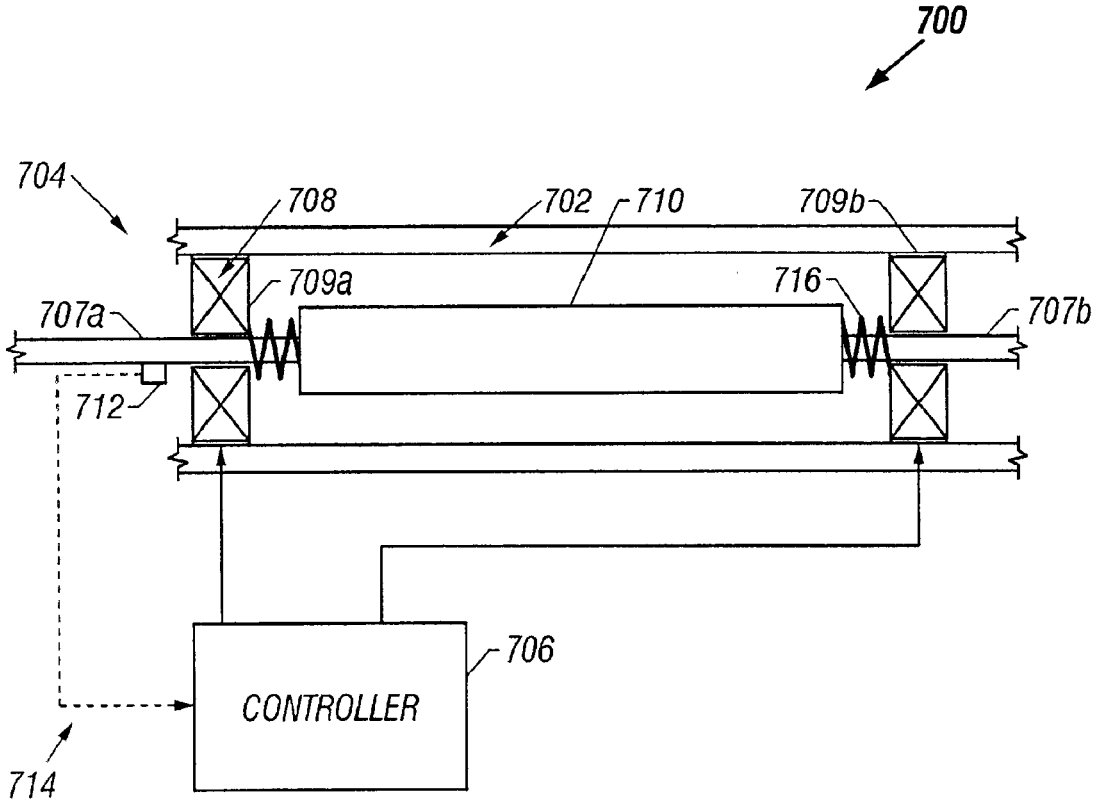
FIG. 7 is a conceptual schematic diagram of an alternative embodiment of the present invention.

FIG. 7 is a system schematic of an acoustic transmitter having a linear electromagnetic drive according to an alternative embodiment of the present invention. The acoustic transmitter system 700 includes a substantially tubular passageway (tube) 702 having a central bore. The tube 702 may be, for example, a jointed drill pipe, coiled tube or a well production pipe through which pressurized drilling mud, formation fluid or a combination of drilling mud and formation fluid flows. Fluid flow through the tube is a typical environmental condition. However, the present invention is adaptable to tubes having no fluid as well.

An acoustic transmitter assembly 704 is mechanically coupled to the tube 702. An input device such as an environmental sensor (not shown) is disposed at a predetermined location and is in communication with the acoustic transmitter assembly.

The acoustic transmitter 704 comprises a controller 706, an electromagnetic drive 708, a reaction mass 710, a displacement sensor 712, and a feedback loop 714. The controller 706 is in communication with electromagnetic drive 708 and the feedback loop 712. The electromagnetic drive 708 is coupled to the reaction mass 710 such that electrical energy communicated from the controller to the electromagnetic drive is transformed into mechanical energy causing linear displacement of the reaction mass 710. The displacement is in a substantially longitudinal direction with respect to the tube 702. The displacement sensor 712 is operatively associated with the reaction mass such that displacement of the reaction mass 710 is measured by the displacement sensor 712. A sensor output signal representative of the measured displacement is communicated to the controller 706 via the feedback loop 714.

The electromagnetic drive 708 may comprise a first drive 709*a* and a second drive 709*b* disposed at opposite ends of the reaction mass 710. One or more biasing elements 716 may be disposed on at least one end of the reaction mass for urging the reaction mass in a longitudinal direction. The biasing element 716 may be a fluid spring such as liquid or gas, metal spring or any other suitable biasing device. Upper and lower plungers 707*a* and 707*b* are coupled to the reaction mass 710 and extend through the electromagnetic drives 709*a* and 709*b*.

The controller 706 is preferably a processor-based controller well known in the art. The controller may be disposed within the tube 702 or at a remote location such as at the well surface.

The electromagnetic drive 708 is preferably a linear electromagnetic drive.

The reaction mass 710 is preferably an elongated member extending longitudinally within the passageway. The reaction mass 710 is movably coupled to the tube 702 via the biasing elements 716 when used and electromagnetic drive 708. In applications without separate biasing elements, the coupling between the reaction mass and electromagnetic drive 708 may be magnetic only.

The displacement sensor 712 may be any device capable of measuring movement of the reaction mass 710. The sensor 712 preferably measures movement of the reaction mass. The sensor may be an infrared (IR) device, an optical sensor, an induction sensor or other sensor or combination of sensors known in the art.

A sensor output signal is conveyed from the sensor 712 to the controller 706 via the feedback loop 714. The controller 706 controls electrical power delivery to the electromagnetic drive 708 based in at least part on the output signal of the displacement sensor 712.

In this configuration, the reaction mass can reciprocally move within the tube at a relatively large resonate amplitude with low frequency. One advantage realized by high amplitude and low frequency is a high signal to noise ratio.

In operation the not-shown environmental sensor sends a first signal indicative of a parameter of interest to the controller 706. The measured parameter may be any formation, drill string, or fluid characteristic. Examples these characteristics include downhole temperature and pressure, azimuth and inclination of the drill string, and formation geology and formation fluid conditions encountered during the drilling operations.

The first signal is communicated to the controller 706 via a typical conductor such as copper or copper alloy wire, fiber optics, or by infrared transmission. The controller 706 then sends electrical power (energy) to the electromagnetic drive 708 via conductors well known in the art. The source of electrical power may be selected from known sources suitable for a particular embodiment. The power source may be, for example, a mud turbine, a battery, or a generator.

The controller 706 converts the first signal to a power signal for exciting the electromagnetic drive 708. The electromagnetic drive then resonates the reaction mass 710 to create an acoustic wave in the structure of the tube 702. The acoustic wave travels through the tube 702 to a receiver (not shown) capable of sensing the acoustic wave. A converter (not shown) converts the acoustic wave into a second signal representative of the first signal. The second signal may then be converted to a suitable output such as a display on a screen, a printed log or it may be saved via known methods for future analyses.

Figure 8A:
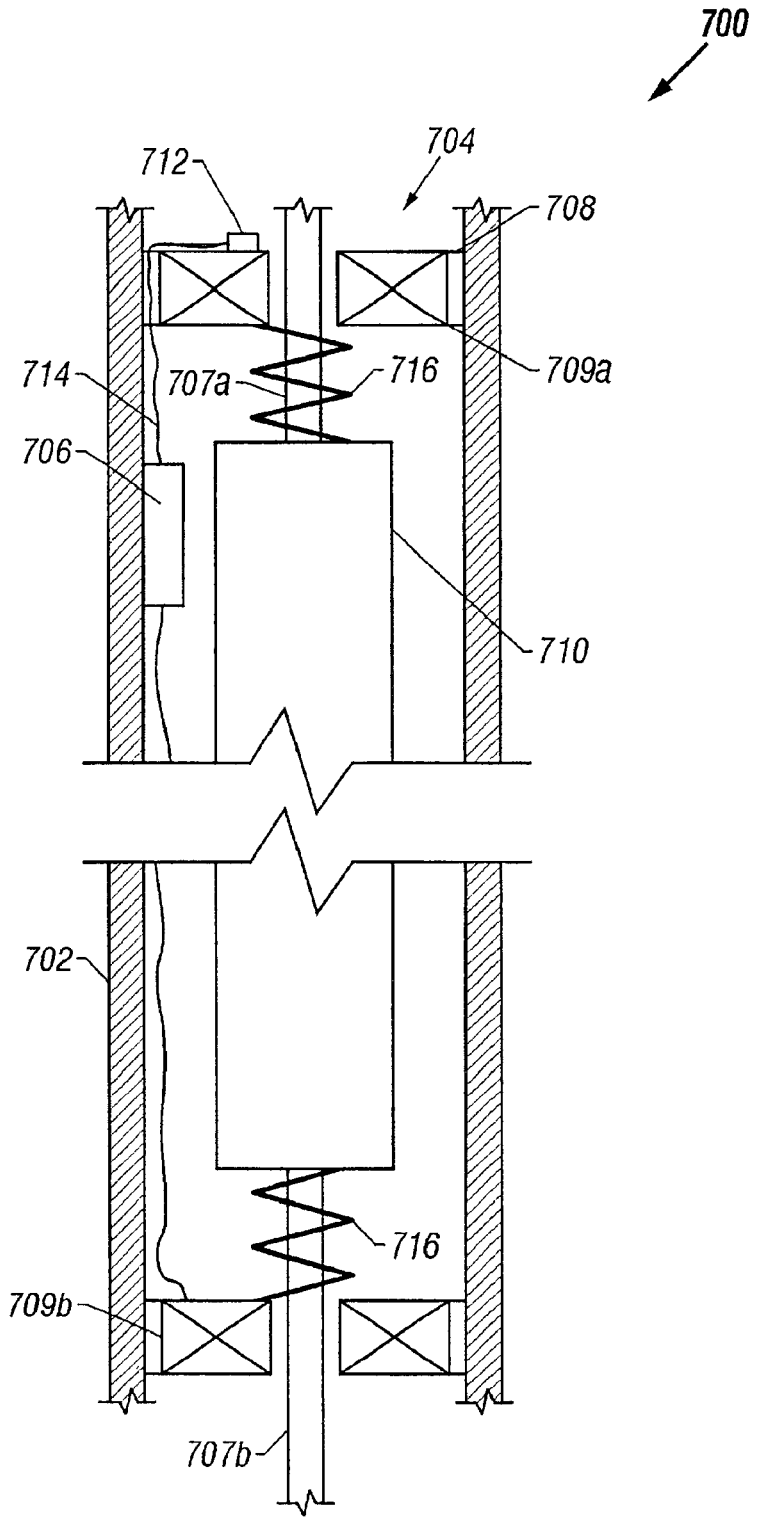
FIGS. 8A–8B show two embodiments of the present invention having different fluid flow paths with respect to a reaction mass.
Figure 8B:
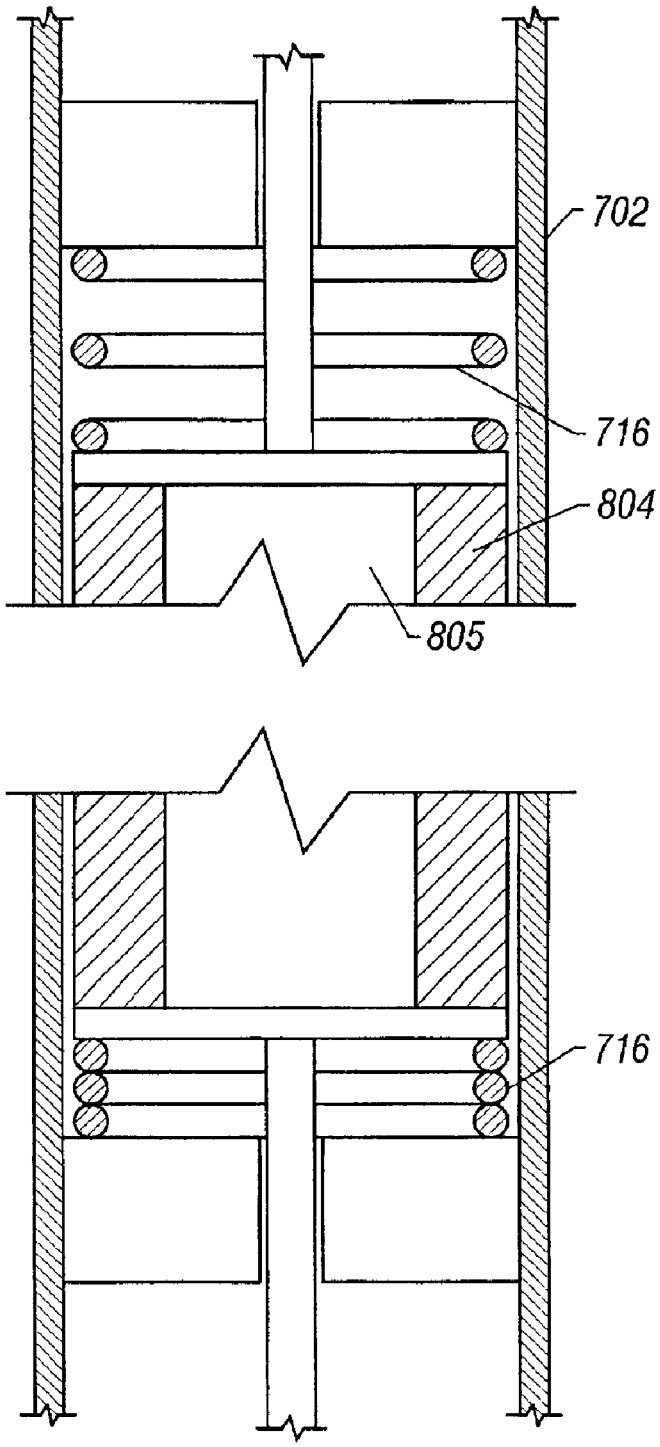

FIGS. 8A–8C show various alternative embodiments for a linear electromagnetic drive acoustic transmitter according to the present invention. FIG. 8A is substantially identical to the system schematic described above and shown in FIG. 7. FIG. 8A shows a controller 706 coupled to a tube 702 within the central bore of the tube 702. All element couplings and operations associated with the embodiment of FIG. 8A are as described above with respect to FIG. 7.

FIG. 8B shows an alternative electromagnetic drive embodiment wherein a reaction mass 804 includes a central flow path 805 to allow drilling fluid to pass therethrough. Otherwise, the embodiment of FIG. 8B is substantially identical to the embodiments described above and shown in FIGS. 7 and 8A.

Figure 9A:
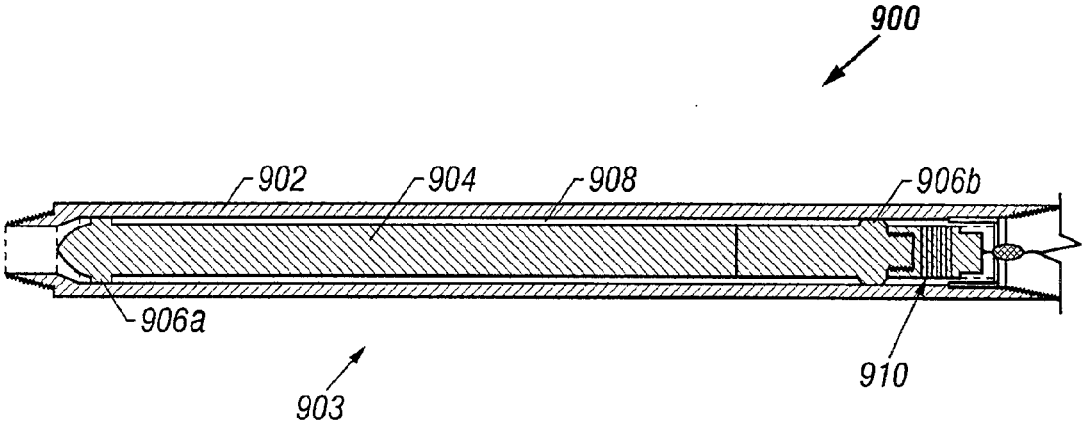
FIG. 9A is an alternative embodiment of the present invention wherein a valve is used to restrict flow of pressurized drilling fluid to excite an acoustic actuator.
Figure 9B:
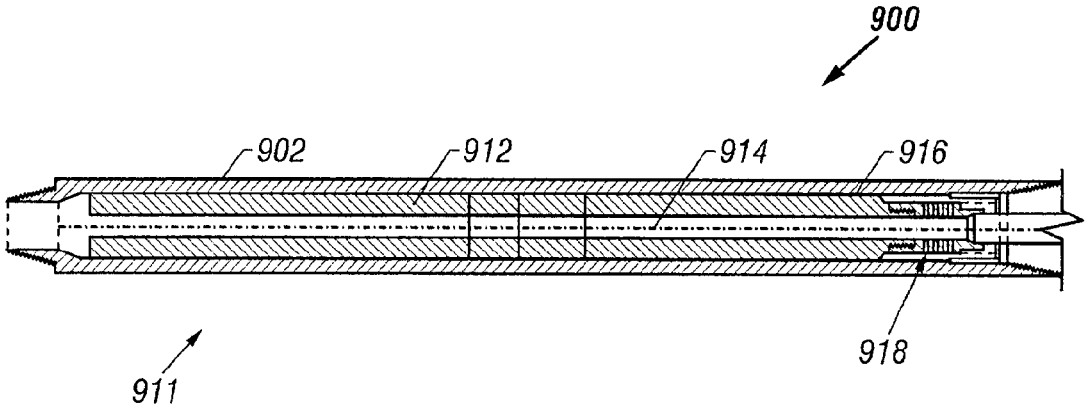
FIG. 9B is an alternative embodiment wherein the reaction mass is a hollow tube and a valve is used to restrict fluid flow to initiate oscillation of the hollow tube.

FIGS. 9A and 9B show alternative embodiments of the present invention having resonant acoustic transmitters. The embodiments described above and shown in FIGS. 2–8B all utilize drive devices that convert electrical energy to force applied to a reaction mass. The embodiments of FIGS. 9A and 9B, in the alternative, utilize kenetic energy of pressurized drilling fluid flowing in the drillstring to resonate a reaction mass.

FIG. 9A shows a portion of drill string 900 comprising a tube 902. An acoustic transmitter 903 according to an embodiment of the present invention is housed within the tube 902. The transmitter 903 is a spring-mass system that comprises a reaction mass 904 and a drive device 910. The reaction mass 904 is slidably disposed within the tube 902. Guides 906*a* and 906*b* are coupled to the reaction mass 904 to inhibit motion perpendicular to the longitudinal axis of the device.

The transmitter 903 is excited with forces generated through pressure changes in the flow of drilling fluid, which is redirected to the system. The fluid path is altered with a valve 910 or other flow restricting device such that the kinetic energy of the flowing drilling fluid is converted to force applied to the reaction mass 904.

The drive device 910 is coupled to the reaction mass 904 at preferably one end. The drive device 910 is a fast-operating valve used to restrict fluid flow through the tube thus creating a pressure differential that acts on an area of the reaction mass 904 substantially equal to the bore area of the tube 902.

The fast operating valve may include a rotating valve or a poppet valve. If a rotating valve is used, the rotating valve could have either axially or radially arranged openings. The rotating valve could be driven by a synchronous motor or a stepper motor to open and close the valve openings using a base frequency and higher or lower frequencies to transmit signals.

A poppet valve is any arrangement of a variable flow restrictor typically comprised of a piston that moves axially and thus closes an orifice partially or completely. A pilot valve (not shown) may be used to reduce the power requirements for a poppet valve, or the high pressure could be used to partially compensate for the forces that have to be created by the valve actuator.

FIG. 9B shows an alternative arrangement of an acoustic transmitter 911 using fluid pressure changes to initiate oscillating motion of a reaction mass 912. Shown is a portion of a drill string 900 similar in most respects to the device shown in FIG. 9A. The drill string 900 includes a drill pipe 902 having a central bore. An acoustic transmitter 911 according to the present invention is housed within the central bore of the drill pipe 902.

The acoustic transmitter 911 comprises a reaction mass 912 having a longitudinal bore 914 to allow flow of drilling fluid therethrough. A fast-operating valve 918 is coupled to one end of the reaction mass 912. The mass is preferably biased with a spring or other suitable biasing element (not separately shown) to enhance oscillating motion when the valve 918 is operated.

In one arrangement, drilling fluid flows through the central bore 914 with the valve 918 being used to restrict or stop flow altogether at predetermined frequencies.

In another arrangement, an additional channel 916 for fluid flow is located between the outside wall of the reaction mass 912 and the inside wall of the drill pipe 902. The valve 918 in this arrangement is configured such that no fluid passes through the central bore 914 when the valve is activated. All of the fluid bypasses at the outside of the mass 912 and actuator 918 through the outer channel 916.

Another embodiment similar to the one just described again has a central bore 914 inner and an outer flow channel 916. Each path will have a nozzle for constant flow restriction configured such that the flow restriction of the outer channel 916 is substantially equal to the flow restriction in the central bore 914. This arrangement allows the use of a fluidic valve known in the art as a Coanda valve to direct fluid either to the outer channel 916 or to the central bore 914 thus creating pulsating forces onto the spring mass combination.

Control of the Coanda valve can be accomplished by either using a control line connecting the two main flow channels of a Coanda at the entrance of these channels or by disturbing the flow at the entrance of one or both main flow channels.

When using a control line, the Coanda valve operates at a stable frequency determined by the dimensions of the control line (length, area of cross-section, shape of cross-section, and fluid properties). In order to switch from the base frequency to another frequency, the dimensions of the cross section are changed. This can be accomplished using, for example, a flow restrictor such as an adjustable valve. Two or more fully or partially parallel control lines may be used to control the frequency by switching between the control lines thus modulating the main frequency.

When using pressure disturbance to control frequency a control line, flow disturbance at the entrance of one or both main flow channels is accomplished, for example by moving an obstacle (not shown) into the flow path or injecting a small amount of fluid into the entrance of a main channel through a small orifice.

An operational advantage gained by the use of any of the preceding embodiments is that the reaction mass being oscillated by any of these actuators could also be used to apply pulsed forces to the drill bit for the purpose of drilling enhancement. When using the embodiments shown in FIGS. 9A–9B in particular drilling operations would be improved through the pressure pulses and consequently flow pulses helping to clean the bit or the bottom of the hole, and also by changing the hydraulic forces applied to the rock.

Another advantage in using any of these actuators is realized by using the forces generated in the drill pipe as a seismic actuator through the transfer of the forces to the bit.

The actuators described above and shown in FIGS. 9A–9B provide a dual purpose advantage in that they are not only inducing forces into the drill pipe for an acoustic axial signal transmission in the drill pipe but they are also creating pressure pulses traveling to the surface in the drilling fluid. The drilling fluid pulse provides a redundant signal that may be used to help to improve signal detection at the surface.

Any of the actuators described above can be modified without departing from the scope of the present invention to convert axial forces generated by the reaction mass into a tangential force thus creating a fluctuating torque to the drill pipe. The fluctuating torque may be used as a method of signal transmission that could have less signal attenuation and thus allow transmitting data over a longer distance.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. An acoustic telemetry apparatus for transmitting signals from a first location within a well borehole to a second location, comprising:

(a) an elongated member having a longitudinal bore;

(b) a reaction mass moveably disposed on the elongated member; and (c) an actuator coupled to the elongated member and the reaction mass at the first location within the well borehole, the actuator actuated to induce an axial reciprocating movement of reaction mass relative to the elongated tube, whereby the reciprocating movement causes an acoustic wave to transmit into the elongated member, the acoustic wave being indicative of the signal.

2. An apparatus according to claim 1, further comprising a controller for controlling the apparatus.

3. An apparatus according to claim 1, further comprising a displacement sensor for sensing a position of the reaction mass relative to the elongated member.

4. An apparatus according to claim 1, further comprising a controller, a displacement sensor and a feedback loop connected to the sensor and controller for conveying an output of the displacement sensor to the controller, the conveyed output at least partially determinative of controller actions in controlling the actuator.

5. The apparatus of claim 1, wherein the elongated member is selected from a group consisting of (i) a jointed drill pipe, (ii) a coiled tube, and (iii) a production tube.

6. The apparatus of claim 1, wherein the actuator is at least one electromagnetic device coupled to the reaction mass and to the elongated tube.

7. The apparatus of claim 6, wherein the at least one electromagnetic device is a linear electromagnetic drive.

8. The apparatus of claim 6, wherein the at least one electromagnetic device is at least two electromagnetic devices comprising a first electromagnetic device and a second electromagnetic device, the first electromagnetic device coupled being coupled to the reaction mass at a third location and the second electromagnetic device being coupled to the reaction mass at a fourth location spaced apart from the third location.

9. The apparatus of claim 1, wherein the actuator is coupled to the reaction mass with a biasing element.

10. The apparatus of claim 9, wherein the biasing element is at least one spring.

11. The apparatus of claim 1, wherein the reciprocating movement is an oscillation at a predetermined frequency.

12. The apparatus of claim 11, wherein the predetermined frequency is a resonant frequency.

13. The apparatus of claim 1, wherein the actuator is a fluid control device.

14. An apparatus according to claim 1, wherein the fluid control device is a fast operating valve.

15. An apparatus according to claim 13, wherein the fluid control device is a rotating valve.

16. An apparatus according to claim 15, further comprising a motor for operating the rotating valve.

17. The apparatus according to claim 16, wherein the motor is selected form a group consisting of (i) a synchronous motor and (ii) a stepper motor.

18. The apparatus according to claim 13, wherein the fluid control device is a variable flow restrictor.

19. The apparatus of claim 18, wherein the variable flow restrictor is a poppet valve.

20. The apparatus of claim 19, wherein the flow restrictor further comprises a pilot valve.

21. The apparatus of claim 13, wherein the first passageway is a substantially annular space between the reaction mass and the elongated member and extending at least partially along the length of the reaction mass.

22. The apparatus of claim 13, wherein the first passageway is a central bore extending through the reaction mass.

23. A method of transmitting a signal from a first location within a well borehole to a second location comprising:

(a) conveying into the borehole on an elongated member having a longitudinal bore, a reaction mass and an acoustic actuator, the reaction mass being movably disposed on the elongated member and operatively coupled to the acoustic actuator; and (b) inducing a reciprocating movement in the reaction mass using the acoustic actuator whereby the reciprocating movement causes an acoustic wave to transmit into the elongated member, the acoustic wave being indicative of the signal.

24. The method of claim 23, further comprising controlling the acoustic actuator with a controller.

25. The method of claim 23, further comprising measuring positions of the reaction mass relative to the elongated member with a displacement sensor.

26. The method of claim 23, further comprising measuring position of the reaction mass with a displacement sensor transmitting a value indicative of its measured position to a controller using a feedback loop, and controlling the acoustic actuator with the controller.

27. The method of claim 23, wherein inducing its reciprocating movement is accomplished using an acoustic actuator selected from a group consisting of (i) an electromagnetic drive, (ii) a linear electromagnetic drive, and (iii) a fluid control device.

28. The method of claim 23, further comprising biasing the reaction mass position with the biasing element.

29. The method of claim 23, wherein inducing reciprocating movement in the reaction mass is inducing a reciprocating movement at a the predetermined frequency.

30. The method of claim 29, wherein the predetermined frequency is a resonant frequency.

31. The method of claim 23 further comprising controlling fluid flow within the elongated member with the acoustic actuator, the control flow being used to cause the reciprocating movement.

32. The method of claim 31, further comprising using an actuator selected from a group consisting of (i) a poppet valve and (ii) a rotary valve.

33. The method of claim 32, wherein the rotary valve is selected, the method further comprising controlling its rotary valve with a motor selected from a group consisting of (i) a synchronous motor and (ii) a stepper motor.

* * * * *